US011937703B2

(12) United States Patent
Shi

(10) Patent No.: US 11,937,703 B2
(45) Date of Patent: Mar. 26, 2024

(54) INFLATABLE BED WITH GAS DELIVERY PIPE

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/373,433

(22) Filed: Sep. 27, 2023

(65) Prior Publication Data

US 2024/0016303 A1 Jan. 18, 2024

Related U.S. Application Data

(63) Continuation-in-part of application No. 17/578,087, filed on Jan. 18, 2022.

(30) Foreign Application Priority Data

Sep. 24, 2021 (CN) ..... 202111119977.1
Sep. 24, 2021 (CN) ..... 202122325915.8

(51) Int. Cl.
*A47C 27/08* (2006.01)

(52) U.S. Cl.
CPC ..... *A47C 27/082* (2013.01); *A47C 27/087* (2013.01)

(58) Field of Classification Search
CPC .... A47C 27/082; A47C 27/087; A47C 27/081
See application file for complete search history.

(56) References Cited

U.S. PATENT DOCUMENTS 3,133,696 A 5/1964 Mirando
4,579,141 A * 4/1986 Arff ..... F16K 15/20 251/86
4,745,649 A * 5/1988 Wang ..... A63B 71/145 297/DIG. 3
4,766,628 A * 8/1988 Walker ..... A47C 27/082 137/232
6,543,073 B2 * 4/2003 Wu ..... A47C 7/021 5/713
7,089,618 B1 * 8/2006 Metzger ..... A47C 27/087 5/709
8,024,830 B2 * 9/2011 Wang ..... F04D 29/4246 5/713

(Continued)

FOREIGN PATENT DOCUMENTS

CN 210810160 U * 6/2020 ..... A47C 27/081
CN 212165393 U * 12/2020

*Primary Examiner* — Myles A Throop
(74) *Attorney, Agent, or Firm* — Cooper Legal Group, LLC

(57) ABSTRACT

An inflatable bed includes a bed main body, an inflator pump, and a one-way valve. The bed main body is provided with a bed body chamber and at least one bed edge chamber independent from each other, and the at least one bed edge chamber is arranged around the bed body chamber. The inflator pump is connected to the bed main body, wherein the inflator pump is configured to inflate the bed body chamber and the at least one bed edge chamber. The one-way valve is provided on the inflator pump or the bed main body, wherein the one-way valve is configured to allow only a fluid to enter the bed body chamber.

15 Claims, 6 Drawing Sheets

(56) References Cited

U.S. PATENT DOCUMENTS

| | | | | |
|---|---|---|---|---|
| 8,656,539 | B1 * | 2/2014 | Boyd | A47C 27/087 5/713 |
| 9,254,047 | B1 * | 2/2016 | Schermel | A47C 27/083 |
| 9,879,682 | B1 * | 1/2018 | Beliveau | A47C 27/082 |
| 11,503,920 | B1 * | 11/2022 | Shi | A47C 27/10 |
| 2006/0210413 | A1 * | 9/2006 | Chung | A47C 27/082 417/423.1 |
| 2006/0218728 | A1 | 10/2006 | Liu | |
| 2008/0000030 | A1 * | 1/2008 | Wang | A47C 27/087 5/713 |
| 2008/0087342 | A1 * | 4/2008 | Wang | F04D 25/082 137/624.27 |
| 2010/0014993 | A1 * | 1/2010 | Wang | F04D 25/084 5/713 |
| 2011/0284108 | A1 * | 11/2011 | Wang | F04B 39/0027 137/565.12 |
| 2015/0201760 | A1 * | 7/2015 | Lin | A47C 27/087 5/710 |
| 2022/0202198 | A1 * | 6/2022 | Li | A47C 27/087 |
| 2023/0085076 | A1 * | 3/2023 | Shi | F16L 55/1152 285/139.2 |
| 2023/0098052 | A1 * | 3/2023 | Shi | A47C 27/082 5/706 |

* cited by examiner

B

INFLATABLE BED WITH GAS DELIVERY PIPE

CROSS-REFERENCE TO RELATED APPLICATIONS

The present application is a continuation-in-part of U.S. application Ser. No. 17/578,087, filed on Jan. 18, 2022, which claims the priority benefits of China application No. 202111119977.1, filed on Sep. 24, 2021, and China application No. 202122325915.8, filed on Sep. 24, 2021. The entireties of U.S. application Ser. No. 17/578,087, China application No. 202111119977.1, and China application No. 202122325915.8 are hereby incorporated by reference herein and made a part of this specification.

TECHNICAL FIELD

The present disclosure relates to the field of daily necessities, and in particular, to an inflatable bed.

BACKGROUND ART

An inflatable bed on the market is generally formed by an inflatable chamber. The bed body of the inflatable bed with such a structure is very unstable, and the user may fall over after sitting on it. Because the inflatable bed tends to expand toward the middle, uneven gas pressure and strength may occur in the middle and edges, and the user may slip from the bed body. The existing inflatable bed has the following shortcomings: poor stability and inconvenient use.

SUMMARY

The present disclosure provides an inflatable bed, which can improve stability, is not prone to local collapse or tilt, and is convenient and reliable to use.

The present disclosure provides an inflatable bed, comprising a bed main body, an inflator pump and a one-way valve, wherein the bed main body is provided with a bed body chamber and at least one bed edge chamber independent from each other, and the at least one bed edge chamber is arranged around the bed body chamber. The inflator pump is connected to the bed main body, and the inflator pump is configured to inflate the bed body chamber and the at least one bed edge chamber. The one-way valve is provided on the inflator pump or the bed main body, and the one-way valve is configured to allow only a fluid to enter the bed body chamber.

In an optional embodiment, the bed main body is provided with an inflatable chamber, wherein the gas outlet of the inflator pump is in communication with the inflatable chamber, and wherein the inflatable chamber is in communication with both the bed body chamber and the at least one bed edge chamber.

In an optional embodiment, the inflatable chamber is communicated with the bed body chamber through a first gas delivery pipe, and wherein the one-way valve is provided in the first gas delivery pipe.

In an optional embodiment, the inflator pump is provided in the inflatable chamber, and wherein the gas inlet of the inflator pump is in communication with an outside.

In an optional embodiment, the inflatable chamber communicates with the at least one bed edge chamber through a second gas delivery pipe.

In an optional embodiment, the bed main body comprises two end walls, a peripheral wall, and at least one reinforcing wall. The peripheral wall has two open sides opposite to each other. The two end walls are respectively sealingly connected with the two open sides, jointly defining the bed body chamber. The at least one reinforcing wall is simultaneously sealingly connected with the outer surface of the peripheral wall and the outer surface of one of the two end walls, jointly defining the bed edge chamber.

In an optional embodiment, the bed main body further comprises a dividing wall. The dividing wall is connected with the inner surface of the peripheral wall, and the dividing wall and the peripheral wall jointly define the inflatable chamber.

In an optional embodiment, the at least one reinforcing wall comprises a first connecting piece and a second connecting piece that are connected with each other. The first connecting piece and the second connecting piece have an included angle with a fold line formed at the joint thereof. One side of the first connecting piece away from the fold line is provided as a first connecting side, and one side of the second connecting piece away from the fold line is provided as a second connecting side. The first connecting side is connected to the end wall, and the second connecting side is connected to the peripheral wall. After the inflatable bed is inflated, the first connecting piece protrudes from the end wall in a thickness direction of the bed body chamber.

In an optional embodiment, two bed edge chambers are provided. The two bed edge chambers are both sleeved outside the bed body chamber, and two bed edge chambers are provided at an interval in the thickness direction of the bed body chamber.

In an optional embodiment, the inflatable bed further comprises at least one pull strap. The at least one pull strap is provided in the bed body chamber, and the at least one pull strap is used to restrain the bed body chamber from expanding under the action of the gas pressure.

By providing a bed body chamber and at least one bed edge chamber that are mutually independent, arranging the at least one bed edge chamber around the bed body chamber, and providing a one-way valve between the bed body chamber and the inflator pump, when the inflator pump is used to inflate the bed body chamber and the at least one bed edge chamber, the gas (e.g., air) can directly enter the at least one bed edge chamber. When the gas pressure reaches the set value, the one-way valve is opened, the bed body chamber is inflated, the at least one bed edge chamber, and the bed body chamber do not interfere with each other when being inflated, such that the inflation is convenient. After the inflation of the inflatable bed is completed, due to the function of the one-way valve, the bed body chamber and the at least one bed edge chamber do not communicate with each other, and both of them work independently such that during use, the gas in the bed body chamber does not leak into the at least one bed edge chamber, and the bed body chamber is not prone to sudden local pressure change, achieving enhanced stability. In addition, the at least one bed edge chamber is arranged around the bed body chamber to enhance the stability of the bed body chamber such that when an edge of the inflatable bed is stressed, the inflatable bed does not easily collapse or tilt locally, and the stability of the inflatable bed is high during use.

BRIEF DESCRIPTION OF THE DRAWINGS

In order to illustrate the technical solutions of the embodiments of the present disclosure more clearly, the drawings required to be used in the embodiments will be briefly introduced below. It should be understood that the following drawings show some embodiments of the present disclosure and should not be regarded as a limitation of the scope, and for those ordinarily skilled in the art, other relevant drawings can also be obtained in light of these drawings, without using any inventive efforts.

DETAILED DESCRIPTION

Figure 1:
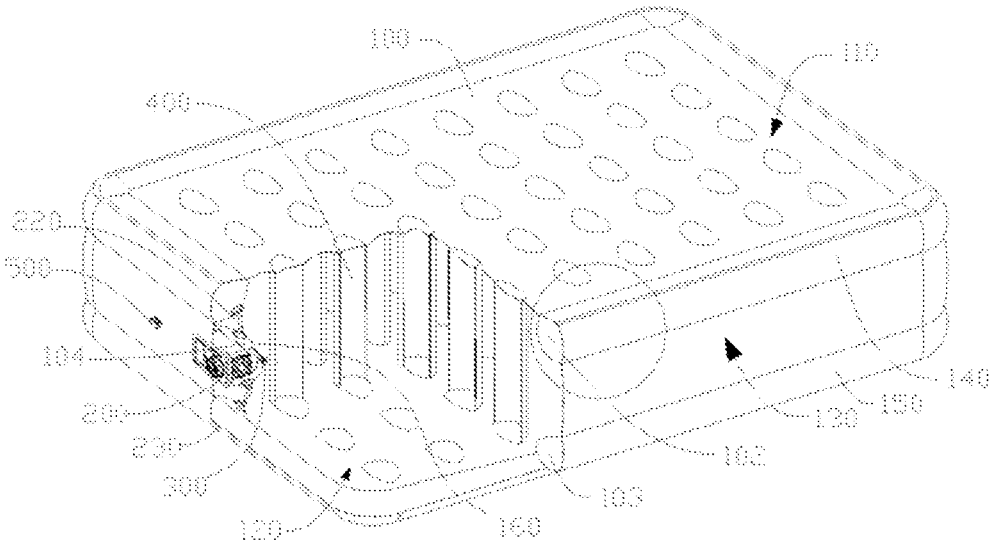
FIG. 1 is a structural schematic view of an inflatable bed of an embodiment of the present disclosure.

In order to make the objectives, technical solutions and advantages of the embodiments of the present disclosure clearer, the technical solutions in the embodiments of the present disclosure will be described clearly and completely below in conjunction with drawings in the embodiments of the present disclosure. Obviously, the described embodiments are some of the embodiments of the present disclosure, rather than all of the embodiments. The components of the embodiments of the present disclosure generally described and illustrated in the drawings herein may be arranged and designed in a variety of different configurations.

Therefore, the following detailed description of the embodiments of the present disclosure provided in the accompanying drawings is not intended to limit the claimed scope of the present disclosure, but merely represents selected embodiments of the present disclosure. Based on the embodiments of the present disclosure, all other embodiments, obtained by those ordinarily skilled in the art without making inventive effort, fall within the protection scope of the present disclosure.

It should be noted that similar reference numerals and letters indicate similar items in the following drawings, therefore, once a certain item is defined in one drawing, it does not need to be further defined and explained in the subsequent drawings.

In the description of the present disclosure, it should be noted orientation or positional relations indicated by terms such as "center", "upper", "lower", "left", "right", "vertical", "horizontal", "inner", and "outer" are based on orientation or positional relations as shown in the accompanying drawings, or an orientation or position that the product is usually placed in while in use. The orientation of positional relations terms are merely for facilitating the description of the present disclosure and simplifying the description, rather than for indicating or implying that related devices or elements have to be in the specific orientation, or configured and operated in a specific orientation. Therefore, they should not be construed as limitations on the present disclosure. The terms "first", "second" and "third" are merely for descriptive purpose, and should not be construed as indicating or implying importance in relativity.

In addition, the terms "horizontal", "vertical" and other terms do not mean that the component is required to be absolutely horizontal or overhanging, but may be slightly inclined. For example, "horizontal" means that its direction is more horizontal than "vertical." "Horizontal" does not mean that the structure must be completely horizontal, but can be slightly inclined.

In the description of the present disclosure, it should be noted that, unless otherwise definitely specified and limited, the terms "arrange", "mount", "link" and "connect" should be understood in a broad sense. For example, they can be fixed connection, detachable connection or integrated connection, they can be mechanical connection or electrical connection, they can be direct connection or indirect connection by intermediate medium, or they may be internal communication between two components. For those ordinarily skilled in the art, the specific meaning of the above terms in the present disclosure can be understood according to the specific situation.

Inflatable bed in the prior art has an inflatable chamber, and when used after inflation, the inflatable bed has poor stability, and tends to incline or dent at a local position, resulting in poor experience.

In view of this, the disclosed inflatable bed having at least two mutually independent chambers, wherein one of the chambers is a main chamber and the other is an auxiliary chamber, and wherein the auxiliary chamber is arranged around the main chamber and can enhance the stability of the edges of the main chamber, so that the main chamber is not easily dented locally or tilted when being used, and has high stability, enabling an enhanced experience.

Figure 3:
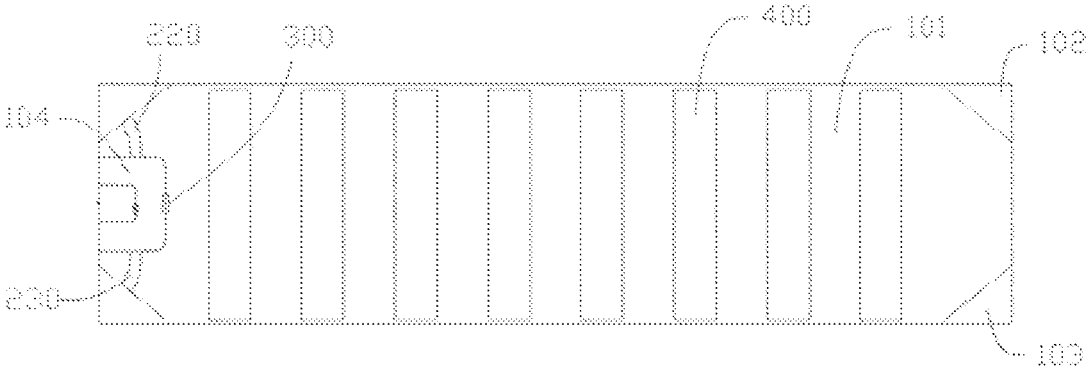
FIG. 3 is a lateral structure schematic view of an inflatable bed of an embodiment of the present disclosure.

Referring to FIG. 1 and FIG. 3, in the present embodiment, an inflatable bed comprises a bed main body 100, an inflator pump 200, a one-way valve 300 and a pull strap 400. The bed main body 100 is provided with a bed body chamber 101, an upper bed edge chamber 102 and a lower bed edge chamber 10, which are independent from each other, The pull strap 400 is provided in the bed body chamber 101, and the pull strap 400 is used to provide tension, such that when the bed body chamber 101 is filled with gas, the expansion of the bed body chamber 101 is suppressed, and such that the bed body chamber 101 maintains the set shape, which is convenient for use. The upper bed edge chamber 102 and the lower bed edge chamber 103 are both arranged around the bed body chamber 101, and are respectively located at the top side and bottom side of the bed body chamber 101. The upper bed edge chamber 102 can enhance the stability of the upper bed edge of the bed body chamber 101. The lower bed edge chamber 103 can enhance the stability of the lower bed edge of the bed body chamber 101 and increase the grip of the inflatable bed. The inflator pump 200 is connected to the bed main body 100. The inflator pump 200 is configured to inflate the bed body chamber 101, the upper bed edge chamber 102 and the lower bed edge chamber 103. The one-way valve 300 is provided on the inflator pump 200 or the bed main body 100, and the one-way valve 300 is configured to allow only fluid to enter the bed body chamber 101.

By providing the bed body chamber 101, the upper bed edge chamber 102 and the lower bed edge chamber 103, which are independent from each other, arranging both the upper bed edge chamber 102 and the lower bed edge chamber 103 around the bed body chamber 101, and providing the one-way valve 300 between the bed body chamber 101 and the inflator pump 200, when the inflator pump 200 is used to inflate the bed body chamber 101 and bed edge chambers, gas can directly enter the upper bed edge chamber 102 and the lower bed edge chamber 103, and when the gas pressure reaches the set value, the one-way valve 300 is opened, the bed body chamber 101 is inflated, and the upper bed edge chamber 102, the lower bed edge chamber 103 and the bed body chamber 101 do not interfere with each other when being inflated, such that the inflation is convenient. After the inflation of inflatable bed is completed, due to function of the one-way valve 300, the bed body chamber 101 and the upper bed edge chamber 102, and the bed body chamber 101 and the lower bed edge chamber 103 do not communicate with each other and work independently, such that during use, the gas in the bed body chamber 101 does not leak into the upper bed edge chamber 102 and the lower bed edge chamber 103, and the bed body chamber 101 does not easily have the situation of local pressure sudden change, and has high stability.

The upper bed edge chamber 102 and the lower bed edge chamber 103 are arranged around the bed body chamber 101 to enhance the stability of the bed body chamber 101, and the inflatable bed is not easily collapsed or tilted locally when the periphery of the top is stressed, and during the use of the inflatable bed, the stability is high and the experience is enhanced.

Referring to FIG. 1, in the present embodiment, optionally, the inflatable bed comprises a top end wall 110, a bottom end wall 120, a peripheral wall 130, reinforcing walls and a dividing wall 160. The top end wall 110 and the bottom end wall 120 are both in an approximately square shape, the peripheral wall 130 is in a shape of an approximate rectangular ring, the peripheral wall 130 has two open sides opposite to each other, the top end wall 110 and the bottom end wall 120 are both sealingly connected with the peripheral wall 130, and the top end wall 110 and the bottom end wall 120 seals the two opening sides of the peripheral wall 130 respectively. The top end wall 110, the bottom end wall 120 and the peripheral wall 130 jointly enclose the bed body chamber 101 that is in a cuboid shape after being inflated. Two reinforcing walls are provided, for ease of description. The two reinforcing walls are respectively a first reinforcing wall 140 and a second reinforcing wall 150, the two reinforcing walls are all in a shape of a roughly rectangular ring, and the first reinforcing wall 140 is simultaneously sealingly connected with the top end wall 110 and the peripheral wall 130, jointly forming the upper bed edge chamber 102 surrounding the upper edge of the bed body chamber 101. The upper bed edge chamber 102 is in a rectangular ring shape after being inflated. The second reinforcing wall 150 is simultaneously sealingly connected with the top wall and the peripheral wall 130, jointly forming the lower bed edge chamber 103 surrounding the lower edge of the bed body chamber 101, and the lower bed edge chamber 103 is in a rectangular ring shape after being inflated. When in use, the second reinforcing wall 150 and the bottom end wall 120 are both in contact with the ground, which plays a supporting role. In addition, the lower bed edge chamber 103 jointly formed by the second reinforcing wall 150, the peripheral wall 130 and the bottom end wall 120 increases the contact area between the inflatable bed and the ground, thereby increasing the friction between the bottom side of the inflatable bed and the ground, so that the grip of the inflatable bed is greater, and the grip is more stable, which has a non-slip effect. In addition, due to the arrangement of the lower bed edge chamber 103, the structural strength of the lower bed edge of the bed body chamber 101 is enhanced, the stability is improved, and the comfort of use is improved.

Figure 2:
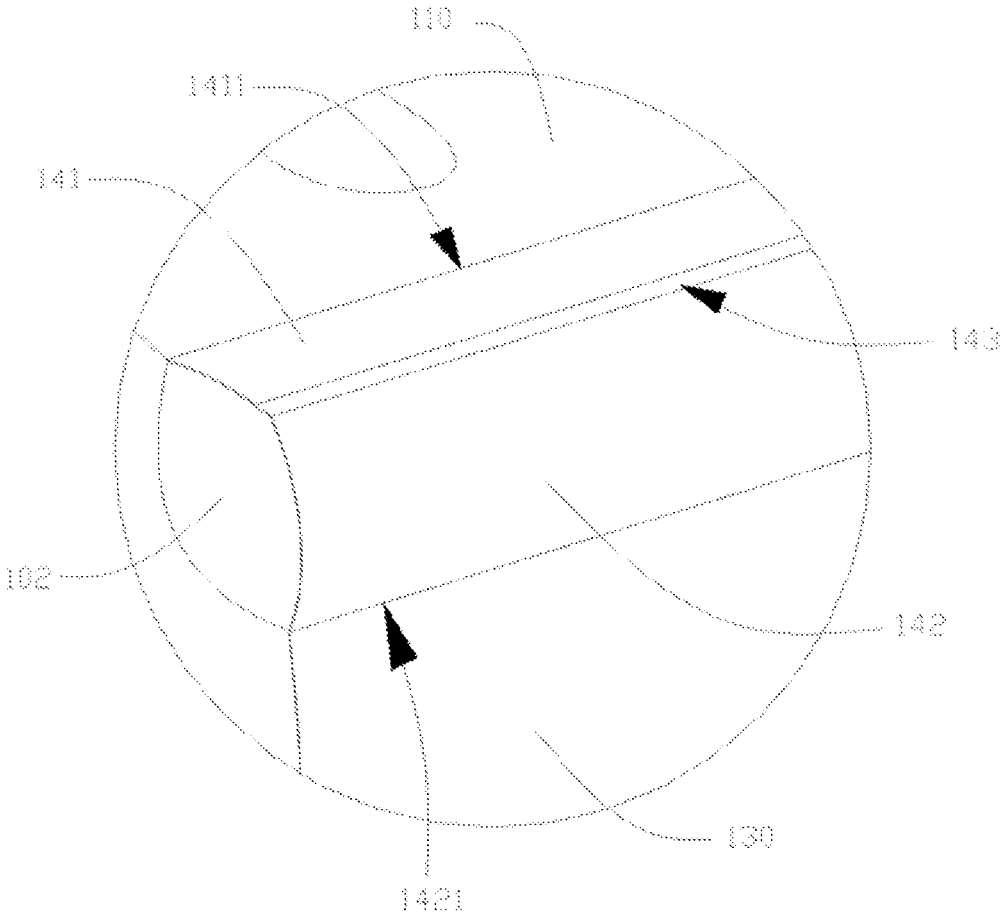
FIG. 2 is a schematic view of a partial enlarged structure corresponding to an embodiment of the present disclosure.

Referring to FIG. 1 and FIG. 2, further, the first reinforcing wall 140 comprises a first connecting piece 141 and a second connecting piece 142 that are connected with each other, the first connecting piece 141 and the second connecting piece 142 have an included angle and a fold line 143 formed at the joint thereof, one side of the first connecting piece 141 away from the fold line 143 is provided as an annular first connecting side 1411, and one side of the second connecting piece 142 away from the fold line 143 is provided as an annular second connecting side 1421, the annular first connecting side 1411 is connected to the top end wall 110, and the annular second connecting side 1421 is connected to the peripheral wall 130, and after the inflatable bed is inflated, the first connecting piece 141 protrudes from the top end wall 110 in the thickness direction of the bed body chamber 101. In this way, after the inflation of the upper bed edge chamber 102 is completed, the first reinforcing wall 140 is stretched, the first connecting piece 141 and the second connecting piece 142 are both expanded, and the outer surface of first connecting piece 141 and the outer surface of the top end wall 110 form an obtuse angle. Generally, when the inflatable bed is in normal use, the top end wall 110 is approximately a horizontal plane, and the outer surface of the top end wall 110 is a surface that supports the human body, the first connecting piece 141 has an upward angle relative to the top end wall 110, and the height of the first connecting piece 141 in the direction away from the top end wall 110 gradually increases, forming an uphill or upward structure, thereby serving to limit, contain, or capture items located on top of the inflatable bed. In this manner, the top end wall 110 can effectively prevent the quilt on the top end wall 110 from slipping off, and can also effectively prevent the user from slipping off the inflatable bed while sleeping, and has enhanced safety.

Optionally, the peripheral edges of the dividing wall 160 are all sealingly connected with the inner surface of the peripheral wall 130, the dividing wall 160 and the peripheral wall 130 jointly define an inflatable chamber 104, the inflator pump 200 is provided in the inflatable chamber 104, and the gas inlet of the inflator pump 200 communicates with the through hole of the peripheral wall 130, so that the gas inlet of the inflator pump 200 communicates with the outside. The inflatable chamber 104 communicates with the bed body chamber 101 through a first gas delivery pipe 210, the one-way valve 300 is provided in the first gas delivery pipe 210, and the one-way valve 300 can be opened when gas pressure is greater than a preset value, thereby inflating the bed body chamber 101 through the inflator pump 200. The inflatable chamber 104 communicates with the upper bed edge chamber 102 through a second gas delivery pipe 220 and communicates with the lower bed edge chamber 103 through a third gas delivery pipe 230. Due to the structural design of the inflatable chamber 104, it is convenient to provide the inflator pump 200, and the inflator pump 200 is located in the inflatable chamber 104 without being exposed to the external environment, and the inflator pump 200 is not easy to be contaminated and has a long service life, and the inflator pump 200 is provided not to protrude the peripheral wall 130, such that the inflatable bed occupies a small space, which is convenient for arrangement.

Figure 4:
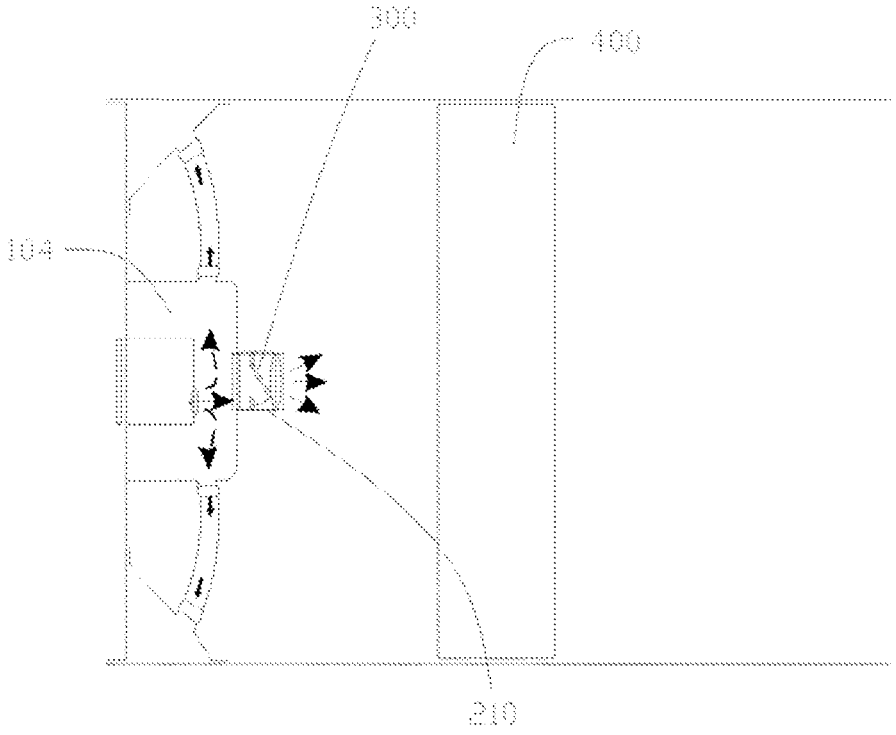
FIG. 4 is a partial structural schematic view of an inflatable bed of an embodiment of the present disclosure.

Referring to FIG. 4, due to the arrangement of the inflatable chamber 104, when the inflator pump 200 is used to inflate the bed body chamber 101, the upper bed edge chamber 102 and the lower bed edge chamber 103, the gas is first delivered to the inflatable chamber 104, and then the gas is distributed to the bed body chamber 101, the upper bed edge chamber 102 and the lower bed edge chamber 103 through the inflatable chamber 104. The inflator pump 200 is provided to complete inflation of multiple chambers, which simplifies the structure and reduces the cost. In addition, when inflating, since the one-way valve 300 is provided in the first gas delivery pipe 210, in the initial stage of inflation, the gas pressure is low, and the one-way valve 300 is in a closed state, and the upper bed edge chamber 102 and the lower bed edge chamber 103 are inflated first, and after the inflated gas reaches the set amount, the one-way valve 300 is opened to inflate the three chambers synchronously. Since the upper bed edge chamber 102 and the lower bed edge chamber 103 are inflated first, the upper bed edge chamber 102 and the lower bed edge chamber 103 are preliminarily inflated and shaped, wherein in the shaping process, the bed body chamber 101 can be spread out, so as to facilitate the subsequent inflation of the bed body chamber 101, and the folding and inflation of the bed body chamber 101 are not easily blocked, and the inflation is smoother.

In the present embodiment, it should be noted that the top end wall 110, the bottom end wall 120, and the peripheral wall 130 may all be sealingly connected by a heat-sealing process. The first reinforcing wall 140, the top end wall 110 and the peripheral wall 130 may be sealingly connected by the heat-sealing process, and the first reinforcing wall 140 may be obtained by connecting four strip-shaped pieces by heat sealing to form a rectangular ring, and then be sealingly connected with the top end wall 110 and the peripheral wall 130. In the same way, the second reinforcing wall 150, the bottom end wall 120 and the peripheral wall 130 may be sealingly connected by the heat-sealing process, and the second reinforcing wall 150 may be obtained by connecting four strip-shaped pieces by heat sealing to form a rectangular ring, and be sealingly connected with the bottom end wall 120 and the peripheral wall 130. The dividing wall 160 may be sealingly connected with the peripheral wall 130 by the heat-sealing process.

In the present embodiment, optionally, the stretchability of the top end wall 110 is less than the stretchability of the bottom end wall 120. In the above, the greater the stretchability, the lower the polyvinyl chloride (PVC) hardness value, and the lower the PVC hardness value, the greater the expansion coefficient, and the greater the stretchability, the easier it is to deform, that is, the bottom end wall 120 is easier to deform than the top end wall 110. The parameter parts per hundred resin (PHR) means that the number of parts of rubber or resin added to every 100 parts by mass of PVC material, and the number of parts of the rubber or resin added indirectly indicates the PVC hardness of PVC. In the above, in the inflatable bed of the present embodiment, the PVC hardness of the top end wall 110 is 50-52 PHR, and the PVC hardness of the bottom end wall 120 is 48-50 PHR, which not only can keep the flatness and enhanced performance of the inflatable bed and avoid the formation of bread-shaped protrusions on the surface of the inflatable bed, but also achieve better matching and adaptation with the hardness and stretchability of the bed body. With this design, since the deformation of the bottom end wall 120 is greater than the deformation of the top end wall 110, after the inflation is completed, the expanded area of the bottom end wall 120 is larger than the expanded area of the top end wall 110, the overall shape of the inflatable bed is roughly a trapezoidal platform, that is, the cross-sectional outline of the inflatable bed is roughly an isosceles trapezoid, such that the stability of the inflatable bed is high, and the use is safer and more comfortable.

Further, the top end wall 110 comprises a PVC flocking layer and a PVC/thermoplastic polyurethane (TPU) adhered cloth layer, which are laminated, and the bottom end wall 120 and the peripheral wall 130 each comprise a PVC cloth adhered layer and a PVC/TPU layer or a PVC/TPU flocking layer, which are laminated. In the above, the flocking layer of the top end wall 110 is provided on the outside of the PVC/TPU layer, that is, on the side away from the bottom end wall 120, the cloth layers of the bottom end wall 120 and the peripheral wall 130 are provided on the outside of the PVC/TPU layer, that is, the cloth layer of the bottom end wall 120 is provided on the side of the PVC/TPU layer away from the top end wall 110, and the cloth layer of the peripheral wall 130 are provided on the side of the PVC/TPU layer away from the bed body chamber 101. The PVC/TPU layers between the top end wall 110 and the peripheral wall 130 and between the bottom end wall 120 and the peripheral wall 130 are welded to each other to jointly define the inflatable chamber 104. The first reinforcing wall 140 and the second reinforcing wall 150 may both be made of the PVC/TPU material.

In the present embodiment, by providing the flocking layer on the top end wall 110 of the inflatable bed, the inflatable bed can be made more delicate and breathable, giving people a more comfortable feeling when in contact with human skin and improving the comfort of use. The cloth layer can reduce the noise generated when the inflatable bed is touched, avoid breakage, and prolong the service life of the inflatable bed. In addition, after the prior art inflatable bed is inflated, the prior art inflatable bed expands more toward the arc-shaped shape, such that the mattress body presents a bread-like protrusion, and the prior art inflatable bed is not flat enough and not beautiful enough, which affects the service life. By contrast, the arrangement of the cloth layer of the present disclosure limits the expansion of the PVC/TPU layer, which makes the overall stretch of the inflatable bed smoother/flat and more beautiful, realizes the technical effects that the entire inflatable bed is not easily deformed, the hardness of inflatable bed is improved, and the inflatable bed is enabled to be more comfortable and has longer service life.

In the present embodiment, it should be noted that a gas escape valve 500 is provided on the peripheral wall 130, and the gas escape valve 500 can discharge the gas in the bed body chamber 101 after being opened. In addition, due to the arrangement of the one-way valve 300, when the gas in the upper bed edge chamber 102 and the lower bed edge chamber 103 is discharged, the gas pressure of the bed body chamber 101 is not affected, and the hardness and comfort of the bed body chamber 101 are not affected. It should be understood that the upper bed edge chamber 102 and the lower bed edge chamber 103 may be exhausted by the inflator pump 200.

In the present embodiment, optionally, the pull strap 400 is provided as a flexible strap (e.g., a belt, a band), the pull strap 400 may be made of a cloth layer, and the pull strap 400 may be in a hollow structure. Obviously, in other embodiments, the pull strap 400 may also be in a sheet shape or a gourd shape or the like. One end of the pull strap 400 is sealingly connected with the top end wall 110, and the other end is sealingly connected with the bottom end wall 120. In addition, there may be multiple pull straps 400, and the multiple pull straps 400 are arranged in the bed body chamber 101 at intervals. It should be understood that each pull strap 400 has an included angle with each of the top end wall 110 and the bottom end wall 120, and the position relationship between the pull strap 400 and the bottom end wall 120 is used for description. The angle between the bottom end wall 120 and the pull strap 400 near the middle of the bed body chamber 101 is 90°, and one end of the pull strap 400 connected to the top end wall 110 is inclined close to the middle of the bed body chamber 101, so that the pull strap is angled away from the middle of the bed body chamber 101, and in this way, the stability of the inflatable bed is high. For example, an angle between the pull strap 400 and the bottom end wall 120 is between 75° and 90°. For example, the angle between the pull strap 400 and the bottom end wall 120 is 75°, 80°, 90°, or the like.

It should be noted that the multiple pull strap 400 may be arranged in a rectangular array. Obviously, in other embodiments, the multiple pull strap 400 may also be arranged in a ring shape or the like.

For the inflatable bed provided by the present embodiment, by providing three independent chambers, and distributing annular chambers at the upper bed edge and the lower bed edge of the bed body chamber 101, the overall stability of the inflatable bed is high, and it is not prone to partial dent or tilt when in use, such that the items and the user on the bed are all not easy to slip off the inflatable bed, and the use comfort is enhanced. In addition, the three chambers are inflated by the cooperation of the inflator pump 200 and the inflatable chamber 104, enabling simple structure and low cost. The gas in the bed body chamber 101 is blocked by the one-way valve 300 and does not overflow, and adjusting the gas pressures of the upper bed edge chamber 102 and the lower bed edge chamber 103 does not affect the hardness and comfort of the bed body chamber 101.

Figure 5:
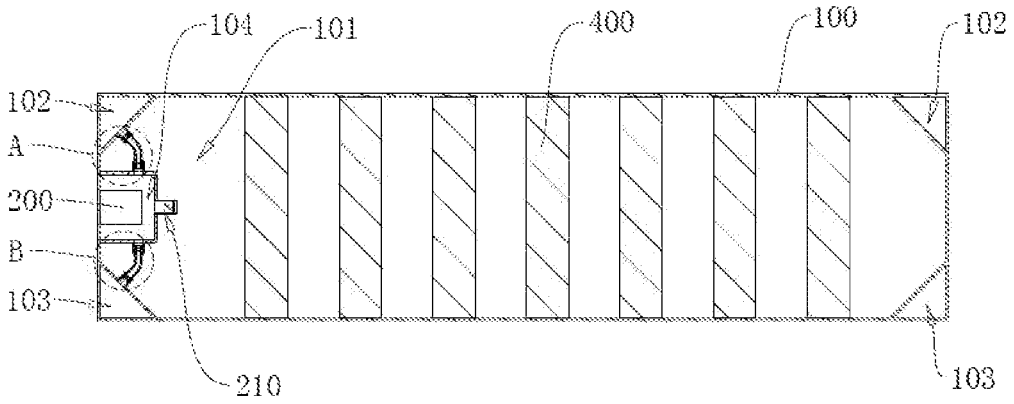
FIG. 5 is a half section view of the inflatable bed of an embodiment of the present disclosure.
Figure 6:
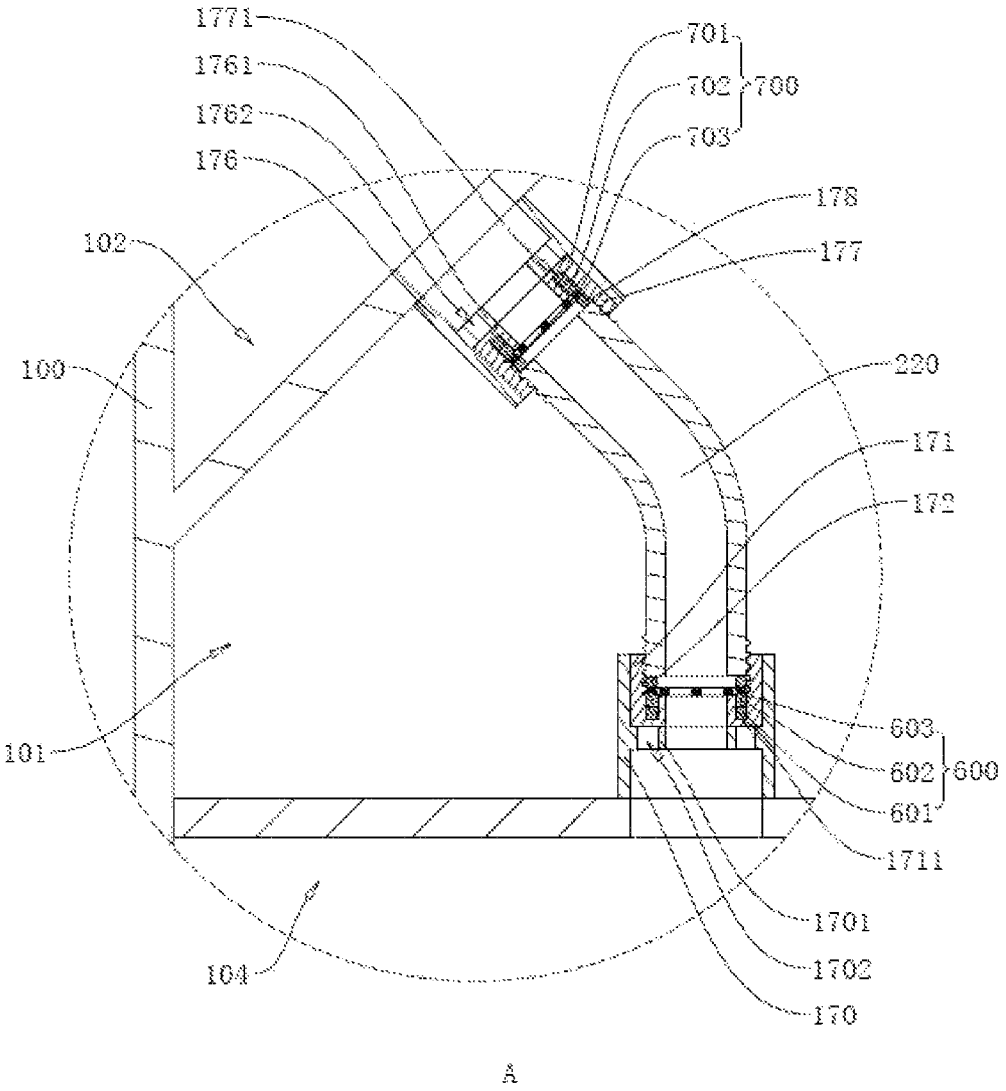
FIG. 6 is a schematic enlarged view of the structure corresponding to part A in FIG. 5 of the embodiment of the present disclosure.

Referring to the embodiment shown in FIG. 5 and FIG. 6, the side of the inflatable chamber 104 close to the upper bed edge chamber 102 is in communication with a first gas outlet pipe 170. The end of the first gas outlet pipe 170 is detachably connected to the outer wall of the inflatable chamber 104. A good seal is achieved between the first gas outlet pipe 170 and the inflatable chamber 104. The side of the upper bed edge chamber 102 close to the inflatable chamber 104 is in communication with a first gas inlet pipe 176. The end of the first gas inlet pipe 176 is detachably connected to the outer wall of the upper bed edge chamber 102. A good seal is achieved between the first gas inlet pipe 176 and the upper bed edge chamber 102. A first annular element 171 is fixedly disposed in the first gas outlet pipe 170. A second annular element 177 is fixedly disposed in the first gas inlet pipe 176. One end of the second gas delivery pipe 220 is screwed to the inner wall of the first annular element 171. The other end of the second gas delivery pipe 220 is screwed to the inner wall of the second annular element 177, which increases convenience of assembling and disassembling of the second gas delivery pipe 220, so as to replace and maintain the second gas delivery pipe 220 more convenient.

Referring to FIG. 6, a first positioning ring 1701 is fixedly disposed on the inner wall of the first gas outlet pipe 170. The end of the first annular element 171 abuts against the first positioning ring 1701. The first positioning ring 1701 is configured not only to position the first annular element 171, but also to prevent the first annular element 171 from moving along the length direction of the first gas outlet pipe 170. The first positioning ring 1701 is configured with a plurality of first relief holes 1702. The plurality of first relief holes 1702 are evenly distributed in the circumferential direction. When the first annular element 171 must be disassembled, the worker can firstly disassemble the first gas outlet pipe 170 from the inflatable chamber 104 and thread a metal rod or the like through the first relief hole 1702 and knock the metal rod or the like, so as to facilitate the disassembly of the first annular element 171 from the first gas outlet pipe 170, which increases convenience for workers to disassemble the first annular element 171.

Referring to FIG. 6, a second positioning ring 1761 is fixedly disposed on the inner wall of the first gas inlet pipe 176. The end of the second annular element 177 abuts against the second positioning ring 1761. The second positioning ring 1761 is configured not only to position the second annular element 177, but also to prevent the second annular element 177 from moving along the length direction of the first gas inlet pipe 176. The second positioning ring 1761 is configured with a plurality of second relief holes 1762. The plurality of second relief holes 1762 are evenly distributed in the circumferential direction. When the second annular element 177 must be disassembled, the worker can firstly disassemble the first gas inlet pipe 176 from the inflatable chamber 104 and thread a metal rod or the like through the second relief hole 1762 and knock the metal rod or the like, so as to facilitate the disassembly of the second annular element 177 from the first gas inlet pipe 176, which increases convenience for workers to disassemble the second annular element 177.

Referring to FIG. 5 and FIG. 6, a first sealing ring 172 is disposed in the first annular element 171. A second sealing ring 178 is disposed in the second annular element 177. One end of the second gas delivery pipe 220 abuts against the first sealing ring 172, while the other end of the second gas delivery pipe 220 abuts against the second sealing ring 178. The first sealing ring 172 increases the sealing performance between one end of the second gas delivery pipe 220 and the first annular element 171, while the second sealing ring 178 increases the sealing performance between the second gas delivery pipe 220 and the second annular element 177, such that it can be ensured that no gas leakage occurs when the upper bed edge chamber 102 is inflated by the inflator pump 200.

Referring to FIG. 6, a first elastic assembly 600 is disposed between the first annular element 171 and the first sealing ring 172. In this embodiment, the first elastic assembly 600 includes a first annular magnet 601, a second annular magnet 602 and a plurality of first springs 603. A first annular groove 1711 is defined in the first annular element 171. The inner wall of the first annular magnet 601 abuts against the inner wall of the first annular groove 1711. The first annular magnet 601 is fixedly connected to the first annular element 171. The first annular groove 1711 is configured to position and fix the first annular magnet 601. The second annular magnet 602 is located in the first annular groove 1711. The inner wall of the second annular magnet 602 abuts against the inner wall of the first annular groove 1711. The first annular groove 1711 is configured to position the second annular magnet 602. The surface of the second annular magnet 602 abuts against the surface of the first annular magnet 601. The first annular magnet 601 and the second annular magnet 602 attract each other, so that the second annular magnet 602 is fixed in the first annular groove 1711. In this embodiment, the plurality of first springs 603 are evenly distributed along the circumferential direction. One end of each first spring 603 is fixedly connected to the second annular magnet 602, and the other end of each first spring 603 is fixedly connected to the first sealing ring 172. During the installation of the second gas delivery pipe 220, the second gas delivery pipe 220 is rotated, so that the end of the second gas delivery pipe 220 presses against the first sealing ring 172, in turn the first sealing ring 172 presses against the plurality of first springs 603 simultaneously, and the plurality of first springs 603 press against the first sealing ring 172, so that the first sealing ring 172 is elastically deformed, which not only increases the sealing performance between the end of the second gas delivery pipe 220 and the first sealing ring 172, but also increases the sealing performance between the inner wall of the first annular element 171 and the sealing ring. Therefore, it is ensured that the gas in the inflatable chamber 104 flows into the second gas delivery pipe 220 through the first gas outlet pipe 170 and the first annular element 171 in sequence.

Referring to FIG. 6, a second elastic assembly 700 is disposed between the second annular element 177 and the second sealing ring 178. In this embodiment, the second elastic assembly 700 includes a third annular magnet 701, a fourth annular magnet 702 and a plurality of second springs 703. A second annular groove 1771 is defined in the second annular element 177. The inner wall of the third annular magnet 701 abuts against the inner wall of the second annular groove 1771. The third annular magnet 701 is fixedly connected to the second annular element 177. The second annular groove 1771 is configured to position and fix the third annular magnet 701. The fourth annular magnet 702 is located in the second annular groove 1771. The surface of the fourth annular magnet 702 abuts against the surface of the third annular magnet 701. The third annular magnet 701 and the fourth annular magnet 702 attract each other, so that the fourth annular magnet 702 is fixed in the second annular groove 1771. In this embodiment, a plurality of second springs 703 are evenly distributed along the circumferential direction. One end of each second spring 703 is fixedly connected to the fourth annular magnet 702, and the other end of each second spring 703 is fixedly connected to the second sealing ring 178. During the installation of the second gas delivery pipe 220, the second gas delivery pipe 220 is rotated, so that the end of the second gas delivery pipe 220 presses against the second sealing ring 178, the second sealing ring 178 in turn presses against the plurality of second springs 703 simultaneously, and the plurality of second springs 703 press against the second sealing ring 178, so that the second sealing ring 178 is elastically deformed, which not only increases the sealing performance between the end of the second gas delivery pipe 220 and the second sealing ring 178, but also increases the sealing performance between the inner wall of the second annular element 177 and the sealing ring, so as to ensure that the gas in the second gas delivery pipe 220 flows into the upper bed edge chamber 102 through the second annular element 177 and the first gas outlet pipe 170 in sequence.

Figure 7:
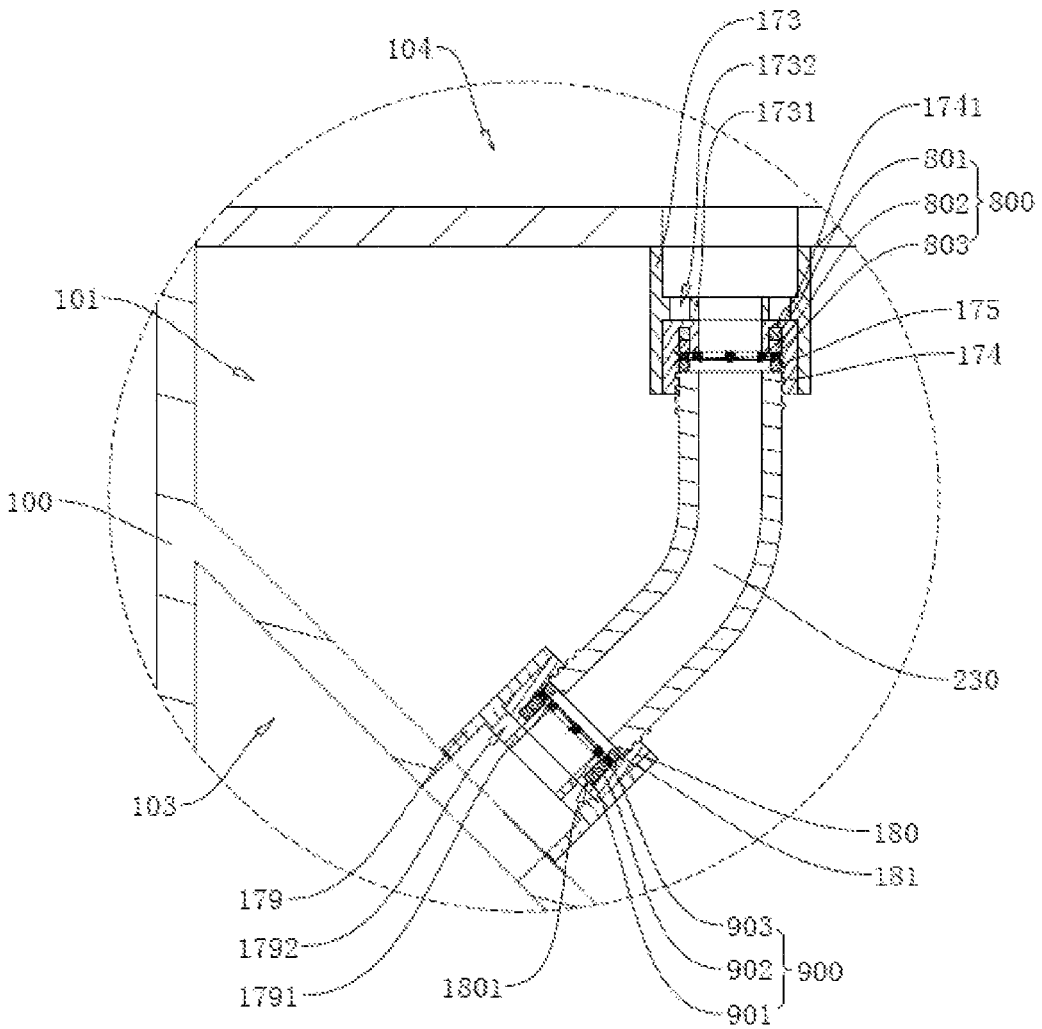
FIG. 7 is a schematic enlarged view of the structure corresponding to part B in FIG. 5 of the embodiment of the present disclosure.

Referring to FIG. 5 and FIG. 7, in this embodiment, the side of the inflatable chamber 104 close to the lower bed edge chamber 103 is in communication with a second gas outlet pipe 173. The end of the second gas outlet pipe 173 is detachably connected to the outer wall of the inflatable chamber 104. A good seal is achieved between the second gas outlet pipe 173 and the inflatable chamber 104. The side of the lower bed edge chamber 103 close to the inflatable chamber 104 is in communication with a second gas inlet pipe 179. The end of the second gas inlet pipe 179 is detachably connected to the outer wall of the lower bed edge chamber 103. A good seal is achieved between the second gas inlet pipe 179 and the lower bed edge chamber 103. A third annular element 174 is fixedly disposed in the second gas outlet pipe 173. A fourth annular element 180 is fixedly disposed in the second gas inlet pipe 179. One end of the third gas delivery pipe 230 is screwed to the inner wall of the third annular element 174. The other end of the third gas delivery pipe 230 is screwed to the inner wall of the fourth annular element 180, which increases convenience for workers to assemble and disassemble the third gas delivery pipe 230, so as to facilitate the replacement and maintenance of the third gas delivery pipe 230.

Referring to FIG. 7, a third positioning ring 1731 is fixedly disposed on the inner wall of the second gas outlet pipe 173. The end of the third annular element 174 abuts against the third positioning ring 1731. The third positioning ring 1731 is configured not only to position the third annular element 174, but also to prevent the third annular element 174 from moving along the length direction of the second gas outlet pipe 173. The third positioning ring 1731 is configured with a plurality of third relief holes 1732. The plurality of third relief holes 1732 are evenly distributed in the circumferential direction. When the third annular element 174 must be disassembled, the worker can firstly disassemble the second gas outlet pipe 173 from the outer wall of the inflatable chamber 104 and thread a metal rod or the like through the third relief hole 1732 and knock the metal rod or the like, so as to facilitate the disassembly of the third annular element 174 from the second gas outlet pipe 173, which increases the convenience for workers to disassemble the third annular element 174.

Further referring to FIG. 7, a fourth positioning ring 1791 is fixedly disposed on the inner wall of the second gas inlet pipe 179. The end of the fourth annular element 180 abuts against the fourth positioning ring 1791. The fourth positioning ring 1791 is configured not only to position the fourth annular element 180, but also to prevent the fourth annular element 180 from moving along the length direction of the second gas outlet pipe 173. The fourth positioning ring 1791 is configured with a plurality of fourth relief holes 1792. The plurality of fourth relief holes 1792 are evenly distributed in the circumferential direction. When the fourth annular element 180 must be disassembled, the worker can firstly disassemble the second gas inlet pipe 179 from the inflatable chamber 104 and thread a metal rod or the like through the fourth relief hole 1792 and knock the metal rod or the like, so as to facilitate the disassembly of the fourth annular element 180 from the second gas inlet pipe 179, which increases the convenience for workers to disassemble the fourth annular element 180.

Referring to FIG. 5 and FIG. 7, a third sealing ring 175 is disposed in the third annular element 174. A fourth sealing ring 181 is disposed in the fourth annular element 180. One end of the third gas delivery pipe 230 abuts against the third sealing ring 175, and the other end of the third gas delivery pipe 230 abuts against the fourth sealing ring 181. The third sealing ring 175 increases the sealing performance between the one end of the third gas delivery pipe 230 and the third annular element 174. The fourth sealing ring 181 increases the sealing performance between the third gas delivery pipe 230 and the fourth annular element 180, such that it can be ensured that no gas leakage occurs when the lower bed edge chamber 103 is inflated by the inflator pump 200.

Further referring to FIG. 7, a third elastic assembly 800 is disposed between the third annular element 174 and the third sealing ring 175. In this embodiment, the third elastic assembly 800 includes a fifth annular magnet 801, a sixth annular magnet 802 and a plurality of third springs 803. A third annular groove 1741 is defined in the third annular element 174. The inner wall of the fifth annular magnet 801 abuts against the inner wall of the third annular groove 1741. The fifth annular magnet 801 is fixedly connected to the third annular element 174. The third annular groove 1741 is configured to position the fifth annular magnet 801. The sixth annular magnet 802 is located in the third annular groove 1741. The inner wall of the sixth annular magnet 802 abuts against the inner wall of the third annular groove 1741. The third annular groove 1741 is configured to position the sixth annular magnet 802. The surface of the sixth annular magnet 802 abuts against the surface of the fifth annular magnet 801. The fifth annular magnet 801 and the sixth annular magnet 802 attract each other, so that the sixth annular magnet 802 is fixed in the third annular groove 1741. In this embodiment, a plurality of third springs 803 are evenly distributed along the circumferential direction. One end of each third spring 803 is fixedly connected to the sixth annular magnet 802, and the other end of each third spring 803 is fixedly connected to the third sealing ring 175. During the installation of the third gas delivery pipe 230, the third gas delivery pipe 230 is rotated, so that the end of the third gas delivery pipe 230 presses against the third sealing ring 175, the third sealing ring 175 in turn presses against the plurality of third springs 803 simultaneously, and the plurality of third springs 803 press against the third sealing ring 175 so that the third sealing ring 175 is elastically deformed, which not only increases the sealing performance between the end of the third gas delivery pipe 230 and the third sealing ring 175, but also increases the sealing performance between the inner wall of the third annular element 174 and the sealing ring, so as to ensure that the gas in the inflatable chamber 104 flows into the third gas delivery pipe 230 through the second gas outlet pipe 173 and the third annular element 174 in sequence.

Further referring to FIG. 7, a fourth elastic assembly 900 is disposed between the fourth annular element 180 and the fourth sealing ring 181. In this embodiment, the fourth elastic assembly 900 includes a seventh annular magnet 901, an eighth annular magnet 902 and a plurality of fourth springs 903. A fourth annular groove 1801 is defined in the fourth annular element 180. The inner wall of the seventh annular magnet 901 abuts against the inner wall of the fourth annular groove 1801. The seventh annular magnet 901 is fixedly connected to the fourth annular element 180. The fourth annular groove 1801 is configured to position and fix the seventh annular magnet 901. The eighth annular magnet 902 is located in the fourth annular groove 1801. The inner wall of the eighth annular magnet 902 abuts against the inner wall of the fourth annular groove 1801. The fourth annular groove 1801 is configured to position the eighth annular magnet 902. The surface of the eighth annular magnet 902 abuts against the surface of the seventh annular magnet 901. The seventh annular magnet 901 and the eighth annular magnet 902 attract each other, so that the eighth annular magnet 902 is fixed in the fourth annular groove 1801. In this embodiment, the plurality of fourth springs 903 are evenly distributed along the circumferential direction. One end of each fourth spring 903 is fixedly connected to the seventh annular magnet 901, and the other end of each fourth spring 903 is fixedly connected to the fourth sealing ring 181. During the installation of the third gas delivery pipe 230, the third gas delivery pipe 230 is rotated, so that the end of the third gas delivery pipe 230 presses against the fourth sealing ring 181, the fourth sealing ring 181 in turn presses against a plurality of fourth springs 903 simultaneously, and the plurality of fourth springs 903 press against the fourth sealing ring 181, so that the fourth sealing ring 181 is elastically deformed, which not only increases the sealing performance between the one end of the third gas delivery pipe 230 and the fourth sealing ring 181, but also increases the sealing performance between the inner wall of the fourth annular element 180 and the sealing ring, so as to ensure that the gas in the third gas delivery pipe 230 flows into the lower bed edge chamber 103 through the fourth annular element 180 and the fourth gas outlet pipe in sequence.

The above are exemplary embodiments of the present disclosure and are not intended to limit the present disclosure. For those skilled in the art, the present disclosure can have various modifications and changes. Any modifications, equivalent replacements, improvements, and the like made within the spirit and principle of the present disclosure shall be included in the protection scope of the present disclosure.

LIST OF REFERENCE SIGNS

100 bed main body
101 bed body chamber
102 upper bed edge chamber
103 lower bed edge chamber
104 inflatable chamber
110 top end wall
120 bottom end wall
130 peripheral wall
140 first reinforcing wall
141 first connecting piece
1411 first connecting side
142 second connecting piece
1421 second connecting side
143 fold line
150 second reinforcing wall
160 dividing wall
170 first gas outlet pipe
1701 first positioning ring
1702 first relief hole
171 first annular element
1711 first annular groove
172 first sealing ring
173 second gas outlet pipe
1731 third positioning ring
1732 third relief hole
174 third annular element
1741 third annular groove
175 third sealing ring
176 first gas inlet pipe
1761 second positioning ring
1762 second relief hole
177 second annular element
1771 second annular groove
178 second sealing ring
179 second gas inlet pipe
1791 fourth positioning ring
1792 fourth relief hole
180 fourth annular element
1801 fourth annular groove
181 fourth sealing ring
200 inflator pump
210 first gas delivery pipe
220 second gas delivery pipe
230 third gas delivery pipe
300 one-way valve
400 pull strap
500 gas escape valve
600 first elastic assembly
601 first annular magnet
602 second annular magnet
603 first spring

700 second elastic assembly
701 third annular magnet
702 fourth annular magnet
703 second spring
800 third elastic assembly
801 fifth annular magnet
802 sixth annular magnet
803 third spring
900 fourth elastic assembly
901 seventh annular magnet
902 eighth annular magnet
903 fourth spring

What is claimed is:

1. An inflatable bed, comprising:

a bed main body;

an inflator pump; and a one-way valve;

wherein the bed main body is provided with a bed body chamber and at least one bed edge chamber which are independent from each other, and the at least one bed edge chamber is arranged around the bed body chamber;

wherein the inflator pump is connected to the bed main body, and the inflator pump is configured to inflate the bed body chamber and the at least one bed edge chamber;

wherein the one-way valve is provided on the inflator pump or the bed main body, and the one-way valve is configured to allow only a fluid to enter the bed body chamber;

wherein the bed main body is provided with an inflatable chamber, the bed main body comprises two end walls, a peripheral wall and a dividing wall, peripheral edges of the dividing wall are sealingly connected with an inner surface of the peripheral wall, and the dividing wall and the peripheral wall jointly define the inflatable chamber;

wherein the inflator pump is provided in the inflatable chamber, a gas outlet of the inflator pump is in communication with the inflatable chamber, and the inflatable chamber is in communication with both the bed body chamber and the at least one bed edge chamber;

wherein the inflatable chamber is in communication with the bed body chamber through a first gas delivery pipe, and the one-way valve is provided in the first gas delivery pipe;

wherein the inflatable bed further comprises at least one pull strap, the at least one pull strap is provided in the bed body chamber, and the at least one pull strap is configured to restrain the bed body chamber from expanding under an action of a gas pressure;

wherein the inflatable chamber is in communication with a first gas outlet pipe, a first annular element is fixedly disposed in the first gas outlet pipe, an upper bed edge chamber is in communication with a first gas inlet pipe, a second annular element is fixedly disposed in the first gas inlet pipe, a first end of a second gas delivery pipe is screwed to an inner wall of the first annular element, and a second end of the second gas delivery pipe is screwed to an inner wall of the second annular element;

wherein a first sealing ring is disposed in the first annular element, a second sealing ring is disposed in the second annular element, the first end of the second gas delivery pipe abuts against the first sealing ring, and the second end of the second gas delivery pipe abuts against the second sealing ring; and wherein a first elastic assembly is disposed between the first sealing ring and the first annular element, the first elastic assembly comprises a first annular magnet, a second annular magnet and a plurality of first springs, the first annular magnet is fixed in the first annular element, a surface of the second annular magnet abuts against a surface of the first annular magnet, the first annular magnet and the second annular magnet attract each other, a first end of each of the plurality of first springs is fixedly connected to the second annular magnet, and a second end of each of the plurality of first springs is fixedly connected with the first sealing ring.

2. The inflatable bed according to claim 1, wherein a gas inlet of the inflator pump is in communication with an outside.

3. The inflatable bed according to claim 2, wherein the bed main body further comprises at least one reinforcing wall, the peripheral wall has two open sides opposite to each other, the two end walls are respectively sealingly connected with the two open sides, jointly defining the bed body chamber, and the at least one reinforcing wall is simultaneously sealingly connected with an outer surface of the peripheral wall and an outer surface of one of the two end walls, jointly defining the bed edge chamber.

4. The inflatable bed according to claim 1, wherein the inflatable chamber communicates with the at least one bed edge chamber through the second gas delivery pipe.

5. The inflatable bed according to claim 4, wherein the bed main body further comprises at least one reinforcing wall; wherein the peripheral wall has two open sides opposite to each other; wherein the two end walls are respectively sealingly connected with the two open sides, jointly defining the bed body chamber; and wherein the at least one reinforcing wall is simultaneously sealingly connected with an outer surface of the peripheral wall and an outer surface of one of the two end walls, jointly defining the bed edge chamber.

6. The inflatable bed according to claim 1, wherein the bed main body further comprises at least one reinforcing wall, the peripheral wall has two open sides opposite to each other, and the two end walls are respectively sealingly connected with the two open sides, jointly defining the bed body chamber; and wherein the at least one reinforcing wall is simultaneously sealingly connected with an outer surface of the peripheral wall and an outer surface of one of the two end walls, jointly defining the at least one bed edge chamber.

7. The inflatable bed according to claim 6, wherein the at least one reinforcing wall comprises a first connecting piece and a second connecting piece that are connected with each other, the first connecting piece and the second connecting piece have an included angle with a fold line formed at a joint thereof, one side of the first connecting piece away from the fold line is provided as a first connecting side one side of the second connecting piece away from the fold line is provided as a second connecting side, the first connecting side is connected to one of the two end walls, the second connecting side is connected to the peripheral wall, and the first connecting piece is configured to protrude from the one of the two end walls in a thickness direction of the bed body chamber after the inflatable bed is inflated.

8. The inflatable bed according to claim 1, wherein the at least one bed edge chamber comprises two bed edge chambers, the two bed edge chambers are both sleeved outside the bed body chamber, and the two bed edge chambers are provided at an interval in a thickness direction of the bed body chamber.

9. The inflatable bed according to claim 1, wherein a first annular groove is defined in the first annular element, an inner wall of the first annular magnet abuts against an inner wall of the first annular groove, and an inner wall of the second annular magnet abuts against the inner wall of the first annular groove.

10. The inflatable bed according to claim 9, wherein a second elastic assembly is disposed between the second sealing ring and the second annular element, the second elastic assembly comprises a third annular magnet, a fourth annular magnet and a plurality of second springs, the third annular magnet is fixed in the second annular element, a surface of the fourth annular magnet abuts against a surface of the third annular magnet, the third annular magnet and the fourth annular magnet attract each other, a first end of each of the plurality of second springs is fixedly connected to the third annular magnet, and a second end of each of the plurality of second springs is fixedly connected with the second sealing ring.

11. The inflatable bed according to claim 10, wherein a second annular groove is configured in the second annular element, an inner wall of the third annular magnet abuts against an inner wall of the second annular groove, and an inner wall of the fourth annular magnet abuts against the inner wall of the second annular groove.

12. The inflatable bed according to claim 10, wherein a second positioning ring is fixedly disposed on an inner wall of the first gas inlet pipe, and an end of the first annular element abuts against the second positioning ring.

13. The inflatable bed according to claim 12, wherein the second positioning ring is configured with a plurality of second relief holes.

14. The inflatable bed according to claim 1, wherein a first positioning ring is fixedly disposed on an inner wall of the first gas outlet pipe, and an end of the first annular element abuts against the first positioning ring.

15. The inflatable bed according to claim 14, wherein the first positioning ring is configured with a plurality of first relief holes.

* * * * *